United States Patent [19]

David

[11] 4,432,735

[45] Feb. 21, 1984

[54] HUMAN PROPELLED BUOYANT ANNULAR FLOAT WITH REMOVABLE PONTOON STABILIZER

[76] Inventor: Constant V. David, 4952 Field St., San Diego, Calif. 92110

[21] Appl. No.: 315,001

[22] Filed: Oct. 26, 1981

[51] Int. Cl.[3] ..... B63H 16/08

[52] U.S. Cl. ..... 440/21; 440/99; 440/100; 114/123

[58] Field of Search ..... 440/21, 22, 90, 98, 440/99, 100; 114/123; 441/65, 66, 67, 76, 78

[56] References Cited

U.S. PATENT DOCUMENTS

| | | | |
|---|---|---|---|
| 277,667 | 5/1883 | Blanchard | 440/21 |
| 1,349,891 | 8/1920 | Kuznetzoff . | |
| 1,804,972 | 5/1931 | De Marchi | 440/21 |
| 2,488,310 | 11/1949 | Mayer | 440/100 |
| 2,663,278 | 12/1953 | Skinner . | |
| 2,948,255 | 8/1960 | Sbrana | 440/21 |
| 3,084,655 | 4/1963 | Becker | 440/99 |
| 3,088,732 | 5/1963 | Hetland . | |
| 3,835,494 | 9/1974 | Dougherty | 9/310 D |
| 3,953,024 | 4/1976 | Brubacher | 440/21 |
| 4,016,826 | 4/1977 | Sanders | 115/26 |
| 4,154,188 | 5/1979 | Flagg | 440/100 |
| 4,379,701 | 4/1983 | David | 440/21 |

FOREIGN PATENT DOCUMENTS

| | | | |
|---|---|---|---|
| 453346 | 8/1926 | Fed. Rep. of Germany | 441/40 |
| 2125604 | 11/1972 | Fed. Rep. of Germany | 440/98 |

*Primary Examiner*—Trygve M. Blix
*Assistant Examiner*—Thomas J. Brahan
*Attorney, Agent, or Firm*—Brown & Martin

[57] ABSTRACT

A buoyant apparatus for transport or amusement which is propelled by a human operator in a standing position. An annular float has a platform secured to its upper side and a plurality of circumferentially spaced fins extending from its lower side. Struts with pontoons are removably connectable to a rotatable mast which extends through the platform. When a human operator strands on an outer ring portion of the platform, the pontoons float in the water and stabilize the annular float in an inclined position, raising the fins on one side of the float out of the water. When the operator walks forwardly, counteracting the torque by holding a paddle against a strut, forward propulsion results. When sufficient skill is acquired, the struts and pontoons are disconnected from the mast, and the operator drags the buoyant paddle in the water to provide balance and counteract torque sufficiently to result in forward propulsion.

8 Claims, 6 Drawing Figures

FIG. 1
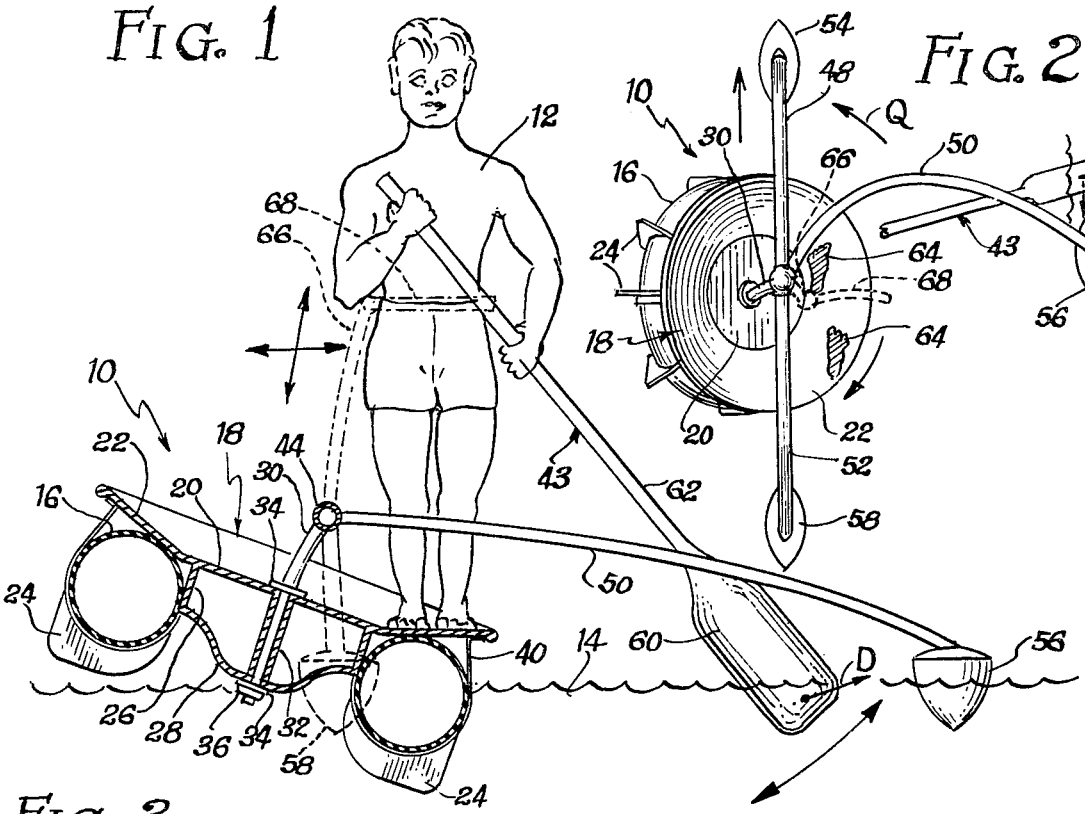
FIG. 2
FIG. 3
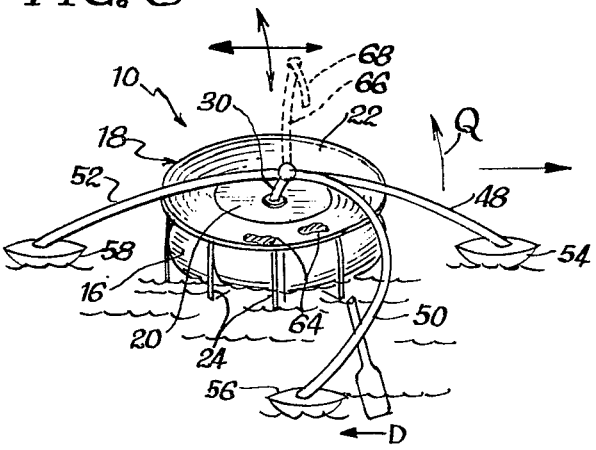
FIG. 4
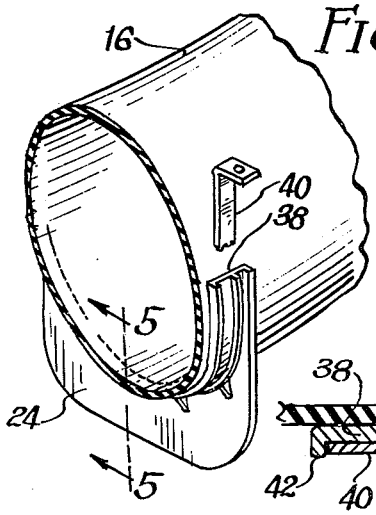
FIG. 5
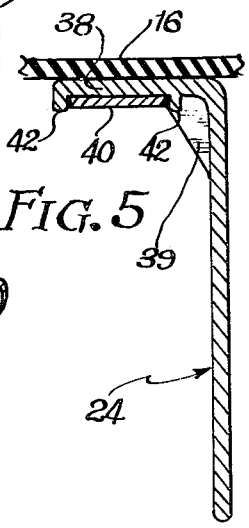
FIG. 6
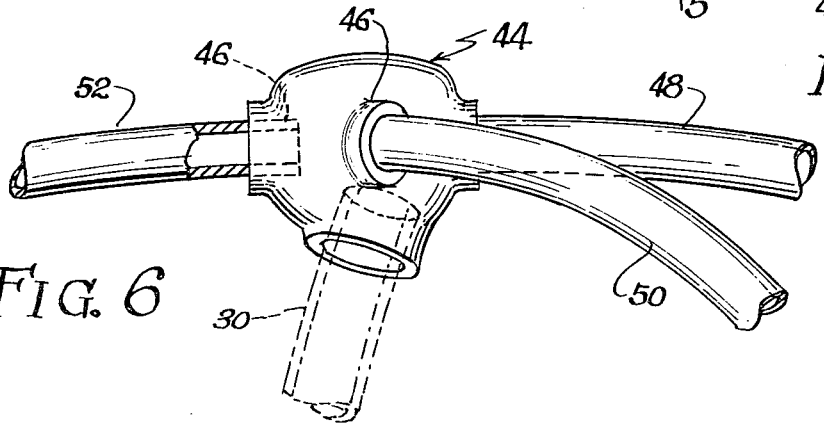

HUMAN PROPELLED BUOYANT ANNULAR FLOAT WITH REMOVABLE PONTOON STABILIZER

BACKGROUND OF THE INVENTION

The present invention relates to human powered buoyant devices and more particularly, to such an apparatus which includes a single annular float which is propelled by a human operator in a standing position.

Many attempts have been made to provide a practical apparatus which would enable a person to propel him or herself through the water in either a standing or sitting position utilizing a walking movement. Although these devices have taken many forms, they have generally proven unsatisfactory due to various problems such as lack of stability, cumbersomeness, complexity, control difficulty and inadequate buoyancy.

SUMMARY OF THE INVENTION

It is the primary object of the present invention to provide a new and improved human propelled buoyant apparatus for transport or amusement which overcomes the above noted problems of prior art devices.

The present invention provides a buoyant apparatus for transport or amusement which is propelled by a human operator in a standing position. In the illustrated embodiment, an annular float has a platform secured to its upper side and a plurality of circumferentially spaced fins extending from its lower side. Struts with pontoons are removably connectable to a rotatable mast which extends through the platform. When a human operator stands on an outer ring portion of the platform, the pontoons float in the water and stabilize the annular float in an inclined position, raising the fins on one side of the float out of the water. When the operator walks forwardly, counteracting the torque by holding a paddle against a strut, forward propulsion results. When sufficient skill is acquired, the struts and pontoons are disconnected from the mast, and the operator drags the buoyant paddle in the water to provide balance and counteract torque sufficiently to result in forward propulsion.

BRIEF DESCRIPTION OF THE DRAWINGS

FIG. 1 is a vertical section view of a preferred embodiment of the apparatus illustrating the manner in which a human operator stands on the apparatus and propels himself through the water.

FIG. 2 is a reduced top plan view of the apparatus of FIG. 1.

FIG. 3 is a reduced perspective view of the apparatus of FIG. 1.

FIG. 4 is an enlarged fragmentary view of a portion of the apparatus of FIG. 1 illustrating the manner in which its fins are secured to its annular float.

FIG. 5 is an enlarged vertical sectional view of one of the fins taken along line 5—5 of FIG. 4.

FIG. 6 is an enlarged fragmentary view of a portion of the apparatus of FIG. 1 illustrating the manner in which the struts of the apparatus which support the pontoons are removably connectable to a rotatable central mast of the apparatus.

DESCRIPTION OF THE PREFERRED EMBODIMENT

Referring to FIG. 1, the illustrated embodiment 10 of my apparatus is shown buoyantly supporting a human operator 12 in a standing position above the surface 14 of a body of water. The apparatus includes a single annular float 16 having sufficient buoyancy to support the human operator above the water. The annular float preferably comprises an inflatable tube made of a flexible material such as plastic or synthetic rubber. By way of example, an automobile innertube may suffice. An annular platform 18 (FIGS. 1–3) is mounted to the upper side of the annular float 16. The platform includes a central disk portion 20 and an outer ring portion 22 which extends angularly upwardly from the outer periphery of the disk portion. The central disk portion 20 of the platform 18 preferably has a diameter which substantially equals the inner diameter of the annular float or tube 16. A plurality of downwardly extending fins 24 (FIG. 1) are secured to the annular float at circumferentially spaced locations about the underside of the annular float 16 as illustrated in FIGS. 2 and 3. The fins 24 have a planar configuration and each fin lies substantially in a plane which intersects the central vertical axis of the annular float 16.

As illustrated in FIG. 1, preferably the displacement buoyancy of the annular float 16 is such that when the human operator 12 stands on the ring portion 22 of the platform, the float will be inclined sufficiently to raise the fins on one side thereof above the surface 14 of the water. Thus, when the human operator walks forwardly on the ring portion 22 of the platform, the rearwardly moving submerged fins beneath him will impart forward propulsion. The fins on the other side of the float which are moving forwardly will not impede such forward movement since they are raised out of the water.

An annular wall 26 (FIG. 1) extends orthogonally from the underside of the platform 18 and fits snuggly within the central opening of the annular float or tube 16. A cover member 28 extends between the lower ends of the annular wall 26 to seal the volume defined between the cover member, the annular wall 26 and the disk portion 20 of the platform. The air within this chamber can aid in buoyantly supporting the apparatus and the human operator. The cover member 28 also serves to prevent a large quantity of water from filling the region defined by the central opening of the annular float or tube 16 which would undesirably impede forward movement of the apparatus in the water.

The apparatus 10 is further provided with a rotatable mast 30 (FIG. 1) which extends through the center of the platform 18 perpendicular to its central disk portion 20. A cylindrical sleeve 32 has its upper and lower ends secured to the center of the disk portion 20 and the cover member 28, respectively. The lower end of the mast 30 extends through and is rotatably journaled in the disk portion 20, the sleeve 32 and the cover member 28. A pair of upper and lower flanges 34 hold the lower end of the mast in position and a retaining member 36 secured over the lower end of the mast 30 removably secures the mast in position.

As illustrated in FIGS. 4 and 5, each of the fins 24 has a generally L-shaped cross section and includes a curved portion 38 which snuggly fits around the outer surface of the annular float or tube 16. A connecting web 39 provides additional stiffness and strength. Straps such as 40 extend around the curved portion 38 of each of the fins to hold them firmly in position, as illustrated in FIG. 1. The opposite ends of each of the straps 40 are formed as illustrated in the fragmented view of the end of a strap 40 in FIG. 4. The opposite ends of each of the straps 40 are removably secured to the underside of the ring portion 22 of the platform and to the annular wall 26 as best seen in FIG. 1. The straps 40 are sufficiently wide so that the straps each extend between ribs 42 (FIG. 5) formed on the curved portions 38 to prevent the straps from sliding off of these portions.

The apparatus 10 may be fitted with pontoons to stabilize the apparatus when the operator 12 is learning how to propel himself. Later on, after the operator acquires sufficient skill, the pontoons can be removed and only a paddle 43 (FIG. 1) is used to provide balance and counteract torque sufficiently to result in forward propulsion. A coupling 44 (FIG. 6) may be removably connected to the upper end of the mast 30. The coupling 44 may have four sockets such as 46 formed therein, each for receiving the force-fitted end of a tubular member which may be removably connected thereto by forcing the end of the tubular member into the socket. Specifically, one of the sockets 46 faces downwardly while the other three sockets face out to the side of the coupling. Three curved struts 48, 50 and 52 (FIGS. 2, 3 and 6) may have their force-fitted inner ends forced into corresponding ones of the sockets 46 in the coupling 44. The struts may comprise lightweight, hollow pipes or tubing having a small degree of downward curvature and made of a resilient material such as resin impregnated fiberglass.

Pontoons 54, 56 and 58 (FIG. 2) are connected to the outer ends of the struts 48, 50 and 52, respectively. Each of the pontoons has an elongated configuration and a V-shaped cross section (FIG. 1). Preferably, the struts extend relative to the mast such that when the human operator stands on the ring portion of the platform, the pontoons will float in the water and stabilize the annular float in an inclined position. The human operator 12 then positions the enlarged portion 60 of the paddle 43 into the water while holding the shaft 62 of the paddle against the strut 50. This enables the operator to stabilize the craft while counteracting the torque which results from walking. Since as illustrated in FIG. 2 the pontoons are spaced approximately ninety degrees apart, the walking movement of the operator will cause the craft to move forwardly.

When walking, the operator balances himself through body movement (forward, backward or sideways) as a person does on a surf board. A representative location of the operator's feet are shown by the outlines 64 in FIG. 2. The operator uses the paddle to counteract the torque which is developed by the reaction of the water on the fins 24. The torque is shown by the arrow Q in FIG. 3. The walking movement of the operator rotates the annular float in the direction shown by the arrow in FIG. 2. Preferably, the paddle is made out of a lightweight foam plastic material and its enlarged portion 60 has an appreciable volume. This permits the operator to use the paddle to vary the sideways restoring torque and to improve the lateral balance of the craft. The paddle is also used in steering the apparatus. The immersed paddle creates a drag force D which counteracts the torque force Q developed by the walking motion of the operator.

As the operator acquires skill and maneuvering the craft, the struts and connected pontoons may be removed one by one. Eventually, when all of the struts have been removed, the operator utilizes a combination of position, depth of immersion and distance from the annular float in the placement of the paddle in order to stabilize himself and counteract the torque resulting from his walking rotation of the float. In this manner, forward propulsion can be achieved.

Having described a preferred embodiment of the human propelled buoyant apparatus, it should be apparent to those skilled in the art that my invention may be modified in both arrangement and detail. For example, the coupling 44 may be provided with an upwardly facing socket 46 for receiving the lower end of a tubular member 66 and having a horizontal push bar 68 at waist level against which the operator pushes, all shown in phantom lines in FIGS. 1, 2 and 3. It permits the torque developed by walking to be counteracted. Therefore, the protection afforded my invention should be limited only in accordance with the scope of the following claims.

I claim:

1. A buoyant apparatus adapted to be propelled by a human operator in a standing position comprising:

an annular float having sufficient buoyancy to support the human operator above the water;

an annular platform mounted to the upper side of the float, the annular platform having a central disk portion and a concentric outer ring portion along the entire periphery of the disk portion which defines a surface extending angularly upwardly from the outer periphery of the disk portion upon which the human operator can walk;

a plurality of downwardly extending fins secured to the annular float at circumferentially spaced locations about the underside of the float;

means for rotatably connecting a stabilizing structure to the center of the disk portion including a mast extending through the center of the platform perpendicular to the central disk portion and a coupling removably connected to the upper end of the mast; and a member extending vertically from the coupling and having a horizontally extending bar adapted to be pushed on by the operator to counteract torque resulting from the operator rotating the float by walking on the platform.

2. An apparatus according to claim 1 and further comprising:

at least one strut having an inner end connectable to the coupling; and a pontoon connected to the outer end of the strut;

the inner end of the one strut being connectable to the coupling so that when the operator stands on the ring portion of the platform, the pontoon will float in the water and stablize the annular float in an inclined position in the water.

3. An apparatus according to claim 1 and further comprising:

a plurality of struts having inner ends connectable to the coupling;

a plurality of pontoons connected to the outer ends of corresponding ones of the struts;

the struts extending relative to the mast in directions such that when the operator stands on the ring portion of the platform, the pontoons will float in the water and stabilize the annular float in an inclined position in the water.

4. An apparatus according to claim 1 wherein the float comprises an inflatable tube, and wherein each fin lies substantially in a plane which intersects the rotational axis of the mast.

5. An apparatus according to claim 4 wherein the central disk portion of the platform has a diameter substantially equal to the inner diameter of the tube.

6. An apparatus according to claim 4 and further comprising an annular wall extending orthogonally from the underside of the platform and fitting snuggly within the central opening of the tube.

7. An apparatus according to claim 6 and further comprising a cover member extending between the lower ends of the annular wall, and having the lower end of the mast rotatably journaled through its center.

8. An apparatus according to claim 4 wherein the fins are removably secured to the tube by straps.

* * * * *